US009896297B2

(12) United States Patent
De Rossi

(10) Patent No.: US 9,896,297 B2
(45) Date of Patent: Feb. 20, 2018

(54) CONTAINER-UNROLLER WITH TEAR CUT AND ELECTRIC CUT, PROVIDED WITH A MECHANISM FOR THE ANTI-REWRAPPING ONE-WAY EXTRACTION OF FILM, ALUMINIUM SHEET OR SIMILAR WRAPPED AROUND A ROLL

(76) Inventor: Patrizio De Rossi, Rome (IT)

( * ) Notice: Subject to any disclaimer, the term of this patent is extended or adjusted under 35 U.S.C. 154(b) by 151 days.

(21) Appl. No.: 13/636,973

(22) PCT Filed: Mar. 22, 2011

(86) PCT No.: PCT/IT2011/000083

§ 371 (c)(1),
(2), (4) Date: Dec. 3, 2012

(87) PCT Pub. No.: WO2011/117902

PCT Pub. Date: Sep. 29, 2011

(65) Prior Publication Data

US 2013/0126577 A1 May 23, 2013

(30) Foreign Application Priority Data

Mar. 22, 2010 (IT) ..... RM2010A0126

(51) Int. Cl.
*B26F 3/02* (2006.01)
*B65H 35/10* (2006.01)
(Continued)

(52) U.S. Cl.
CPC ..... *B65H 35/04* (2013.01); *B65H 35/002* (2013.01); *Y10T 225/201* (2015.04); *Y10T 225/246* (2015.04)

(58) Field of Classification Search
CPC .. B65H 35/0086; B65H 35/04; B65H 35/002; Y10T 225/246; Y10T 225/201
USPC ..... 83/485, 614, 171, 16, 33, 38; 225/7, 39, 225/45–46, 77, 89, 91, 93.5, 38; 242/588.4, 588.6, 598.6
See application file for complete search history.

(56) References Cited

U.S. PATENT DOCUMENTS 2,710,152 A * 6/1955 Jones ..... 225/25
2,759,618 A * 8/1956 Vogt ..... B65H 35/002 156/270

(Continued)

FOREIGN PATENT DOCUMENTS

EP 2154093 A2 2/2010
WO WO 9510475 A1 * 4/1995
WO 97/17272 A1 5/1997

OTHER PUBLICATIONS

International Search Report Dated Jun. 6, 2011.

*Primary Examiner* — Ghassem Alie
*Assistant Examiner* — Bharat C Patel
(74) *Attorney, Agent, or Firm* — Hedman & Costigan, P.C.; James V. Costigan; Kathleen A. Costigan

(57) ABSTRACT

A container-unroller for film, aluminum sheet or similar material wrapped around a roll where the container-unroller has a tubular body for the accommodation of a roll to be contained and a means for control of one-way rotation of said roll. A means for making a hot electric cut and a means for making a tear cut are positioned on the same device where the means for making a tear cut are a metallic saw-toothed bar, connected to electric current. means for making a hot electric cut.

13 Claims, 6 Drawing Sheets

(51) Int. Cl.
*B65H 35/04* (2006.01)
*B65H 35/00* (2006.01)

(56) References Cited

U.S. PATENT DOCUMENTS 2,857,046 A * 10/1958 Klein ..... 242/588.4
2,948,575 A * 8/1960 Kallman et al. ..... 242/588.6
3,131,278 A * 4/1964 Rosenthal ..... 219/214
3,134,005 A * 5/1964 Mayhew ..... B65H 35/008 156/515
3,156,392 A * 11/1964 Johannes ..... 225/38
3,227,340 A * 1/1966 Haley ..... 225/19
3,707,251 A * 12/1972 Dashnier ..... B65H 35/0006 225/21
3,748,939 A * 7/1973 Feinstein et al. ..... 83/370
3,782,615 A * 1/1974 Webster et al. ..... 225/94
4,014,229 A * 3/1977 Lynch ..... 83/16
4,093,204 A * 6/1978 Landgraf ..... B65H 29/38 493/324
4,212,217 A * 7/1980 Heppner ..... B65H 35/002 83/277
4,427,144 A * 1/1984 Macgrory ..... B65H 35/002 225/20
4,712,459 A * 12/1987 Walkiewicz et al. ..... 83/171
4,934,575 A * 6/1990 Mustafa ..... 225/38
5,213,245 A * 5/1993 Puaatuua ..... 225/19
5,253,560 A * 10/1993 McDonald et al. ..... 83/171
5,275,073 A * 1/1994 Zemlak et al. ..... 83/171
5,383,590 A * 1/1995 Ho ..... B65H 35/002 225/43
5,630,563 A * 5/1997 Meisner et al. ..... 242/598.6
5,676,297 A * 10/1997 Sawyer ..... B26D 7/22 225/21
7,008,497 B2 * 3/2006 Nakakado ..... A61F 13/15593 156/160
7,252,216 B2 * 8/2007 Lin et al. ..... 225/38
7,424,904 B2 * 9/2008 Lammers et al. ..... 156/523
2007/0000935 A1 * 1/2007 Pavlik et al. ..... 221/33
2007/0137454 A1 * 6/2007 DesRosiers et al. ..... 83/614
2010/0019013 A1 * 1/2010 Jamie ..... B65D 83/0841 225/91

* cited by examiner

CONTAINER-UNROLLER WITH TEAR CUT AND ELECTRIC CUT, PROVIDED WITH A MECHANISM FOR THE ANTI-REWRAPPING ONE-WAY EXTRACTION OF FILM, ALUMINIUM SHEET OR SIMILAR WRAPPED AROUND A ROLL

The present invention concerns a container-unroller with electric cut and tear cut, provided with a mechanism for the anti-rewrapping one-way extraction of film, aluminium sheet or similar around a roll.

Particularly, the invention refers to a container of said type, wherein it is possible to insert from time to time rolls of film for food use, paper for food use, i.e. so-called food grade oven paper, aluminium sheet and like and allowing unwrapping without rewrapping, said container being provided with means facilitating tear cut of said sheets or films wrapped around a roll and inserted in the container and further allowing, as desired, the film to be cut by contact with an heated element as a result of electric current flow as well (below through the current specification named electric cut).

Currently commercially available food grade oven paper, aluminium film or sheet rolls 1 are generally offered to buyers enclosed within containers with a box body made of paperboard or similar material. The cut of the sheet, or film, wrapped around the roll, occurs by means of the aid of a saw-toothed bar, fixed in cutting position, located on the container rib, therefore potentially dangerous when by chance touched.

This type of containers, moreover, generally is not provided with mechanism preventing reliably from undesired opening, resulting in the possibility of an easy opening, thus exposing the sheet or film therein to the contamination by outside agents and products.

Further since the roll disposed inside of the container is not fixed in any way to said container, when the container and the roll therein are put away, the roll, being free, at minimum motion drags inside of the container the edge of the sheet i.e. film remaining after previous extraction and tear. This occurrence, associated to the fact that food grade transparent films are generally self-adherent, result in the edge of previously unwrapped film sticking disorderly on its-self and the part of film remains wrapped around the roll, creating difficulty during the successive extraction step, during which it is often necessary the container to be opened manually trying to find the film edge, with a consequent loss of time and a possible contamination for food to be stored.

U.S. Pat. No. 5,630,563 describes a device for the release of a controlled amount of film or sheet 1 from a roll. The device comprises a cylindrical container, consisting of two hinged semi-cylinders, suitable to be opened for the insertion of the roll and subsequently moved closer for holding the same, the device being equipped with means to rotate the film or sheet roll 1 along only one way and means preventing the two semi-cylinders from closing completely, defining an opening for the sheet extraction and allowing the roll rotation, and suitable to be contrasted manually by an user, when a desired amount of film or sheet 1 has been extracted, in order to move closer the two semi-cylinders and consequently preventing the roll from further rotation. Further the device comprises means for the cut of the film or sheet 1. The device does not involve any specific trigger in order to facilitate the cut of food grade films, more elastic and difficult to be cut than aluminium or paper sheets.

EP Application No. 154093 describes a container for accommodation of polymer film rolls, particularly for food use, having a port for film extraction and means for hot cut thereof, particularly a heatable filament connected to a power system. Said device does not involve means for the cut of paper or aluminium sheets not susceptible to be cut as result of filament induced heating In this context the solution is disclosed according to the present invention, the object thereof being to provide for a container-unroller provided with electric and tear cut means, at the same time occurring in the container and being interchangeable, further equipped with means for the anti-rewrapping one-way extraction of the film, aluminium sheet or similar wrapped around the roll disposed inside thereof.

The object of the present invention is therefore to provide a container-unroller with electric and tear cut of film, aluminium sheet or similar wrapped around the roll allowing to overcome the limits of container-unrollers according to prior art and above described technical results to be obtained.

A further object of the invention is that said container-unroller can be produced at substantially reduced costs, both as to production and operating costs.

Not last object of the invention is to propose a container-unroller which is simple, safe and reliable.

It is therefore a specific object of the present invention a container-unroller for film, aluminium sheet or similar wrapped around a roll, comprising a tubular body, for the accommodation of a roll to be contained, means for control of one-way rotation of said roll, means for hot electric cut and means for tear cut.

Particularly, according to the invention, said means for hot electric cut and said means for tear cut can be placed on a same device, alternatively in the same position on said device, said means for hot electric cut and said means for tear cut consisting of a metallic saw-toothed bar, connected to means for generation of electric current, or in facing positions on said device, said means for hot electric cut and said means for tear cut consisting, respectively, of an extended wire, connected to tensioning means and electric current generation means and a saw-toothed bar.

Alternatively, according to the invention, said means for hot electric cut and said means for tear cut can consist of two interchangeable devices, and said container-unroller can comprise a track, positioned on the external surface of said tubular body, for the insertion, as desired, of one of said cutting devices.

Preferably, according to the invention, said means for control of one-way rotation of said film, aluminium sheet or similar roll comprises all the inside components of said tubular body, i.e. said closure stoppers, provided with hinges with grooved surface, universal holed stoppers applicable to said roll, respectively one toothed and one simple stopper for each side of said roll, a tooth spring washer on a side of said roll, provided with a hole with a groove correspondent to that of said hinges of closure stoppers, the whole being under a spring pressure.

Further according to the invention, said two closure stoppers have two edges, one inside of the other, apart from each other as the thickness of the said threaded tubular body, the external edge of said stoppers being inside threaded.

Still, again according to the invention, said holed universal stoppers have a cylindrical body, provided with a plurality of longitudinal cuts alternated along all the circumference, forming raised arched fins.

Preferably, according to the present invention, said interchangeable device for hot electric cut has a tubular shape and is provided with an extended steel wire, located on the rib of the device, an electric circuit fed by rechargeable batteries located inside of the instrument, and operated through a switch placed outside of the instrument, and a profile for matching with said tubular body of the container; and said interchangeable instrument for tear cut has a cylindrical shape and is provided with a saw-toothed bar, placed inside of a room, and a cylindrically shaped base, at the two ends being equipped with two hinges, inserted and freely rotating in corresponding holes of said room, allowing the saw-toothed bar to be moved between two positions, namely cutting and resting position, driven by means of a tab located nearly at the opposite of the saw-toothed bar, said saw-toothed bar being provided with blocking means, both for cutting and resting steps, consisting of rounded projections on the head of the saw-toothed bar inserted inside of correspondent recesses placed in the walls of said room, and a profile for matching with said tubular body of the container.

Finally again according to the present invention, the core of said roll can have a reduced circumference, inside of whose holes self-blocking universal holed stoppers are placed, suitable to rotate said roll within hinges of said external closure stoppers, and the transparent plastic film around said roll is coupled to a stiffening strip on the head margin.

The present invention now will be described, by an illustrative, but not limitative way, according to preferred embodiments thereof, with particular reference to enclosed drawings, wherein.

Figure 1:
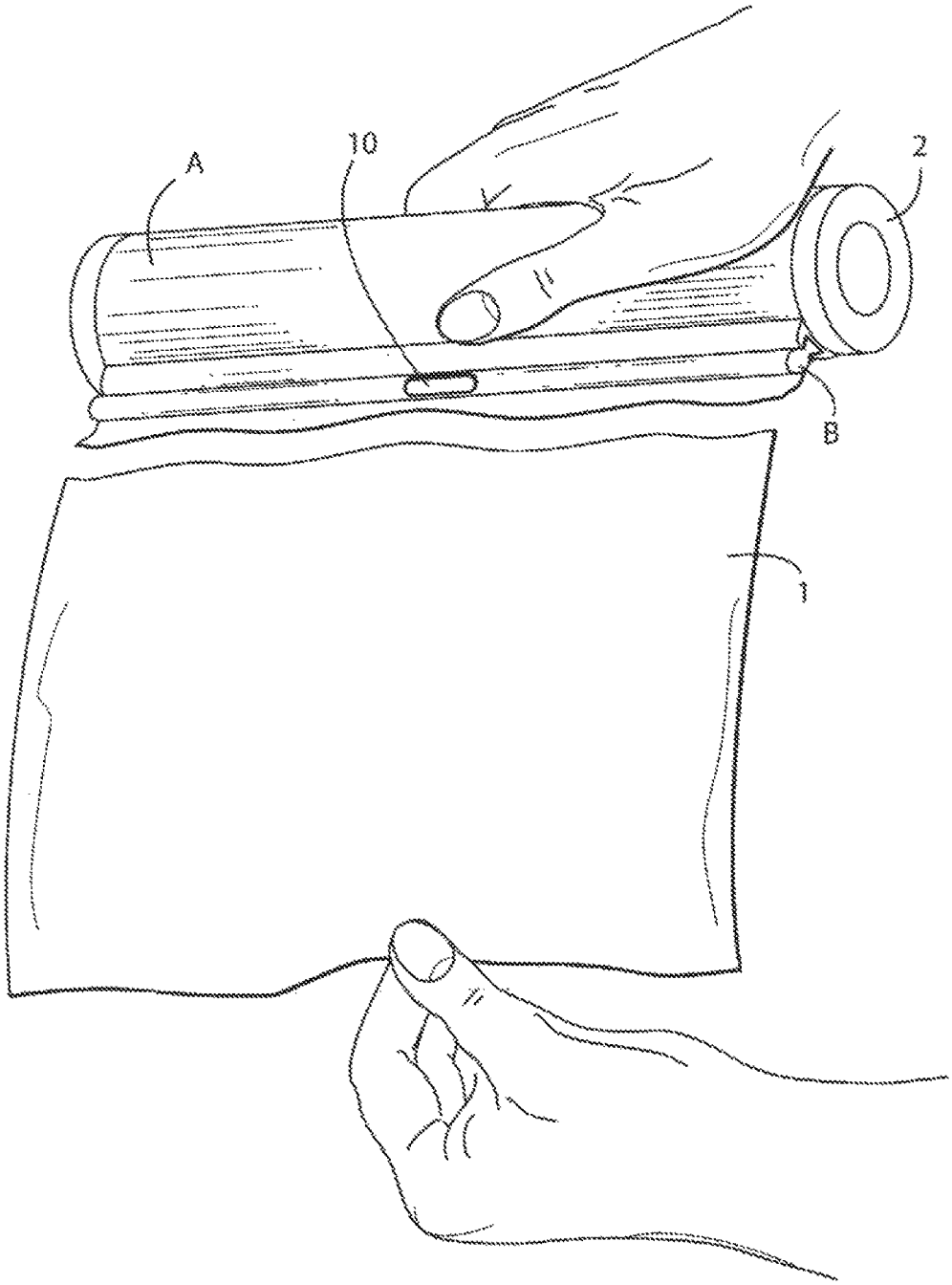
FIG. 1 shows a view of the container-unroller with electric cut and tear cut of film, aluminium sheet or similar wrapped around a roll according to a first embodiment of the present invention, in use.
Figure 2:
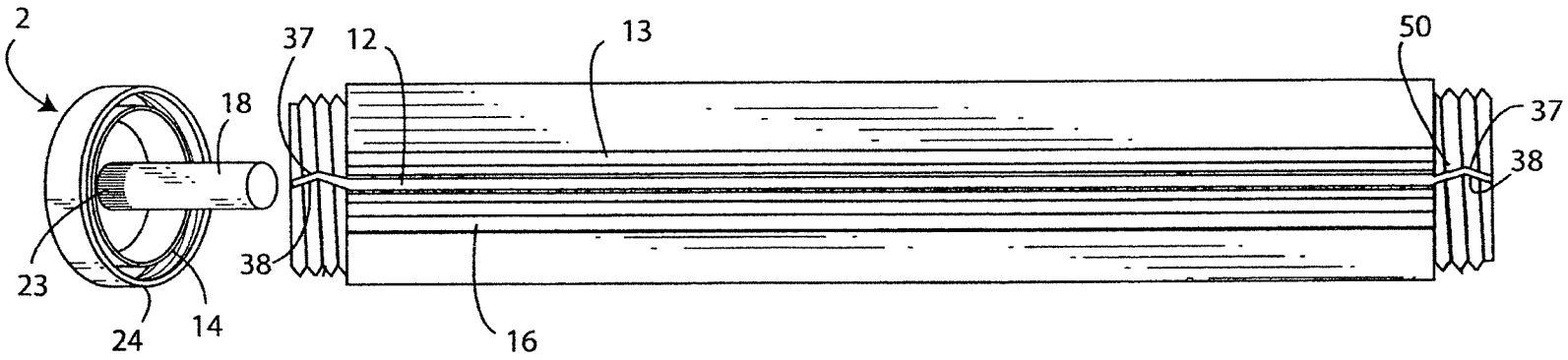
FIG. 2 shows a perspective view of some components of the container-unroller of FIG. 1, i.e. the cylindrical container and the closure stopper, each other apart.
Figure 3:
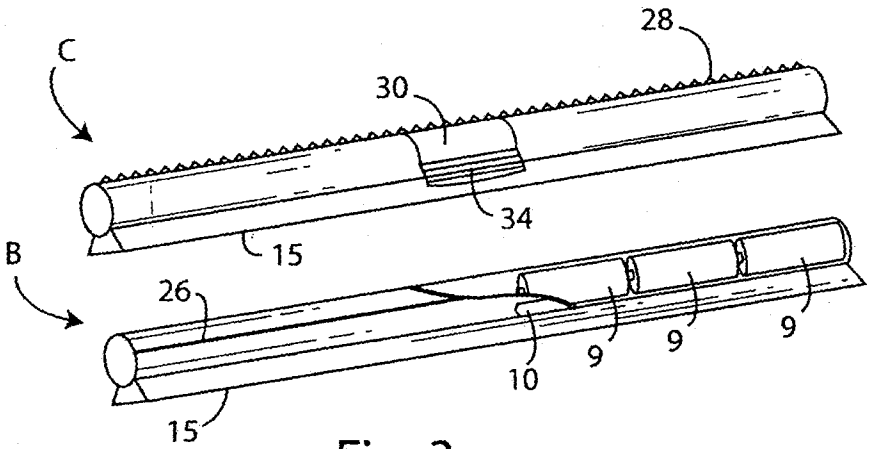
FIG. 3 shows a perspective view of the two interchangeable devices combinable to the container-unroller of FIG. 1, i.e. the devices for hot electric cut and tear cut, respectively.
Figure 4:
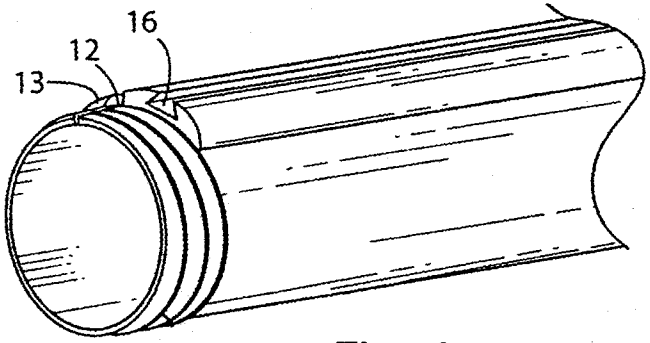
FIG. 4 shows a perspective view of a detail of the cylindrical container of the container-unroller of FIG. 1.
Figure 5:
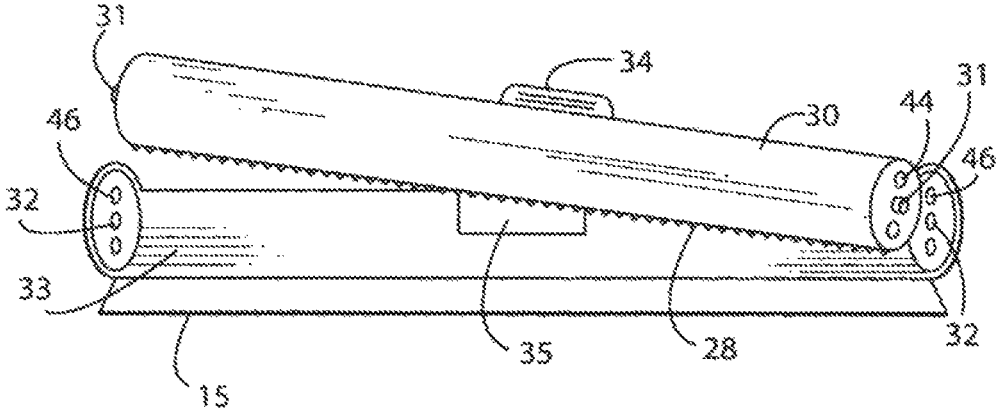
FIG. 5 shows a perspective view of components of the device for tear cut of the container-unroller of FIG. 1, as when the assembling is carried out.
Figure 6A:
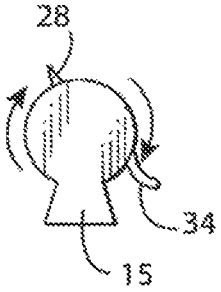
Figure 6B:
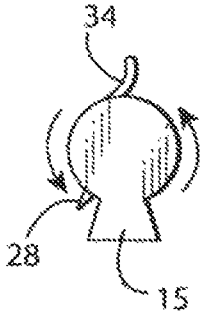
Figure 7:
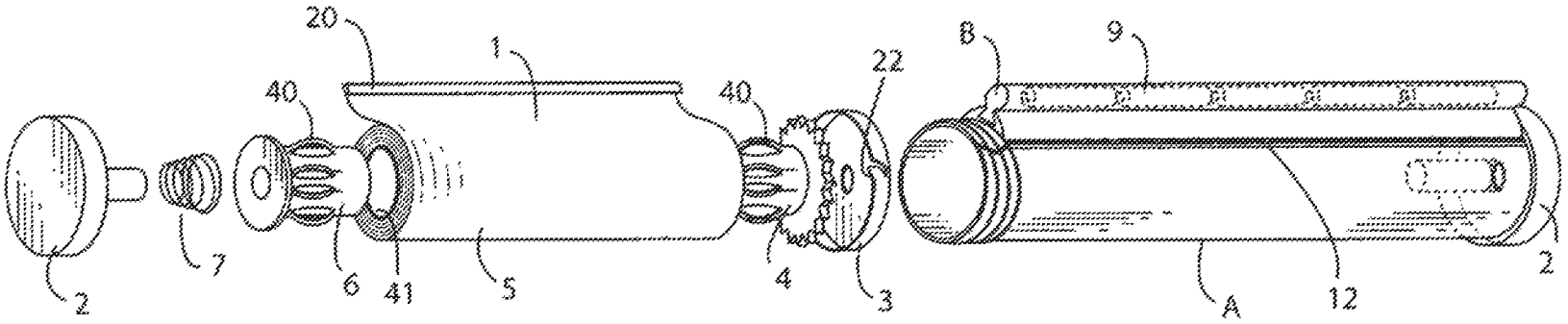
Figure 8:
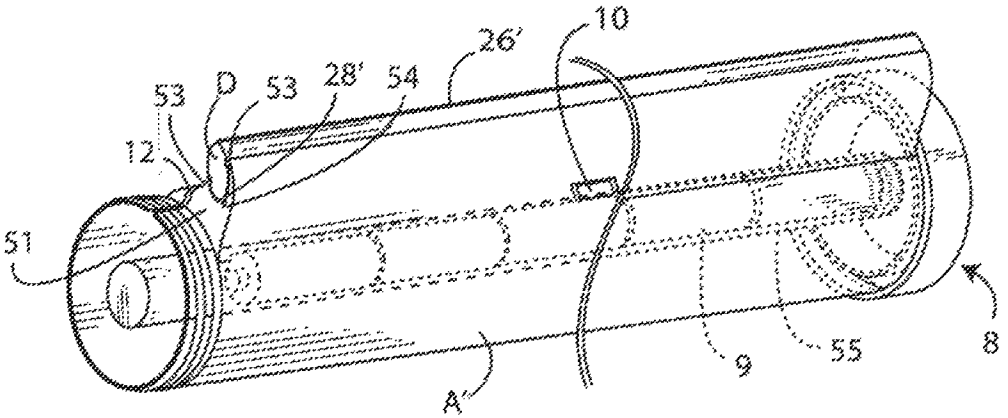
Figure 9:
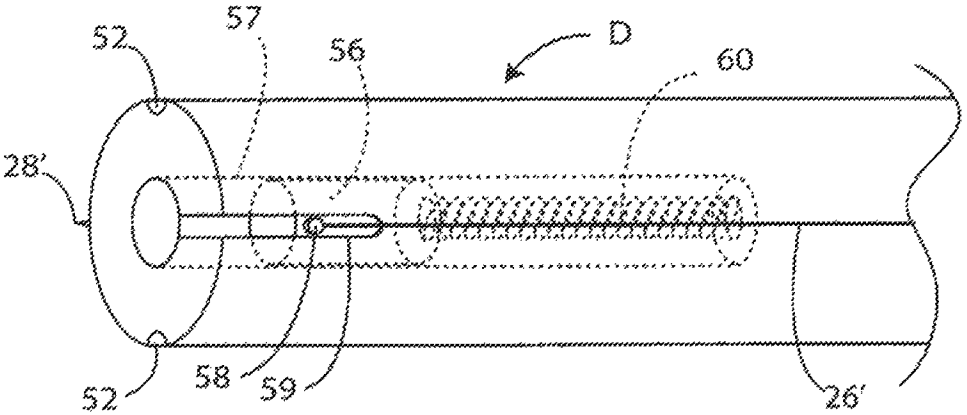

FIGS. 6*a* and 6*b* show a side view of the device for tear cut of the container-unroller of FIG. 1 in cutting and resting position, respectively;

FIG. 7 shows an exploded perspective view of the components of the container-unroller of FIG. 1;

FIG. 8 shows a perspective view of one portion of some components of the container-unroller with electric cut and tear cut of film, aluminium sheet or similar wrapped around a roll according to a second embodiment of the present invention; and FIG. 9 shows a perspective view, partially in transparency, of one portion of the device for hot electric cut and tear cut of the container-unroller of FIG. 8.

Firstly with reference to FIGS. 1-7, wherein the container-unroller with electric cut and tear cut of film, aluminium sheet or similar wrapped around a roll, i.e. components thereof, according to a first embodiment of the present invention, are shown, the cylinder container A is the basic instrument with overlapping track 16 for bayonet insertion of a device B for hot electric cut by means of extended steel wire 26, suitable to cut transparent plastic film 1 in less than one second, or alternatively for the insertion of the device C for tear cut by means of saw-toothed bar, which is suitable to cut, in addition to transparent plastic film, also aluminium sheet or similar, generally used for food product storage.

One of the new elements of the container-unroller according to the present invention is the container-unroller with internal mechanism allowing the film 1 or similar to be extracted manually, preventing from re-entering. A further innovation of the container-unroller according to the first embodiment of the present invention is that, over the rib of the cylinder container A, approximately 2 cm from slit 12 for the passage of the film or sheet 1, a track 16 occurs, allowing the bayonet insertion of the two devices provided for the cut, both mountable on the container, but are separately used depending on designed use.

Advantages as to hygiene and practicality resulting from the subject invention are apparent: when device B for electric cut is mounted on the container, it is possible unrolls the film 1, as desired, by one hand, meanwhile the container-unroller, i.e. the object of the present invention, is hold by the other hand. Pressing switch 10, placed in the centre of device B, more or less under the thumb, the circuit will be closed resulting in the heating of the extended steel wire 26, contextually with a simple rotation of the wrist, the film will be cut as result of said wire contact. Above-mentioned wire is placed approximately 3 cm from the slit 12, determining distance, since after the cut, the film remains outside of the container as necessary for successive use, thus allowing an easy catch of the head edge.

When, on the contrary, the device C is mounted on the container, before of the use the saw-toothed bar 28 is to be placed in cut position (FIG. 6*a*) by means of tab 34 placed in the centre of the device. The saw-toothed bar 28 is blocked both in cutting (FIG. 6*a*) and resting (FIG. 6*b*) step by means of tonguing elements. In cutting step, one hand unrolls the film 1 as desired, while the other hand catches the found element, then a light tear movement is carried out suitable the film 1 to be cut. After the use, said tab 34 is upward moved, switching said saw-toothed bar 28 in resting safe position. The saw-toothed bar is located, as the extended steel wire 26 of the device B, approximately 3 cm apart from the slit, in order to have the same cut point but above all due to above said reasons in order to facilitate the successive use.

Particularly, the container-unroller with electric and tear cut, mechanism for the anti-rewrapping one-way extraction of film, aluminium sheet or similar around a roll, according to the first embodiment of the present invention, as shown with reference to FIGS. 1-7, consists as below described.

The cylinder container A has a tubular shape, little larger than roll 5 to be contained (diameter from approximately 5 to approximately 8 cm and length from approximately 30 to approximately 50 cm), opened along all the length thereof; the two threaded ends touch to each other, while the middle part remains detached being wider and designed to be the slit 12. Threaded ends are overlapped allowing tooth 38, placed in the middle of mutually notched threads (as shown in 37), can enter and preventing from whichever movement cylinder container A already before the closure obtained by means of appropriate closure stoppers 2, blocking and closing the same leaving an opened slit 12 from which film, aluminium sheet or similar 1 will escape. After the closure of the cylinder container using the closure stoppers 2, the structure of the container-unroller will prove to be more resistant and compact. The slit 12 remains opened for approximately 3 mm for a length of approximately 30 cm; on a side a decreasing stiffening rib 13 of approximately 4 mm for 7 mm running along the length of the tube to external stopper thread occurs, thus resulting in a more hard slit edge 12. On the other side of slit 12 there is a decreasing rib of approximately 3 mm×approximately 1.5 cm, with a middle channel resulting in higher rigidity and acting as guide track 16 for the bayonet insertion of devices B and C.

The device B integrally consists of hard plastic, has a semi-tubular shape containing an accommodation room for rechargeable batteries 9, with a switch 10 in the middle. On the upper part an extended steel wire 26 runs that by means of said switch closes the circuit resulting in wire heating. Under the steel wire, in order the underlying plastic to be protected, there is a strip of an insulating and heat resistant material. On the lower part of the device B, there is a profile 15 allowing the bayonet to be inserted in track 16 on the cylinder container.

The device C has more or less the same shape and largeness as the device B, consisting integrally of hard plastic, except that instead of the steel wire there is a saw-toothed bar 28, thus cut points occur at the same height.

The saw-toothed bar 28 is a component of the device C, with a cylindrically shaped base 30 that, placed in a room 33, rotates for about half-turn around axis thereof on two axial hinges 31, passing from cutting to resting position. Hinges 31 of saw-toothed bar 28 are at the edges of the same and rotate within the circular holes 32 occurring at the centre of room walls, the whole being operated by a finger through the tab 34 located on the opposite of the saw-toothed bar; said saw-toothed bar is blocked both in cutting and resting step by means of joints, which are simply round projections 44 on the head of the saw-toothed bar inserted by means a pressure in recesses 46 located in the room walls.

The tab 34, remaining outside of the room, is manipulable through the opening 35 placed in the centre of the room 33, which is opened as necessary to allow the cylindrical base 30 of saw-toothed bar 28 can enter and rotate therein, leaving outside the latter.

In resting position the saw-toothed bar 28 is safe, being placed towards the bottom and joint blocked.

On the lower part of device C there is a profile 15 allowing the bayonet to be inserted in track 16 on the container.

The above-mentioned devices are both mountable on the cylinder container A, but the same will be used separately depending on the intended use; therefore, only at loading time of material type around the roll inside of the container, the device type to be mounted will be selected.

The device B with means for electric cut, is provided with contacts for recharge occurring using an appropriate a battery charger (not shown), made of hard plastic with such a shape to accommodate all the container-unroller object of the invention in vertical position, supporting and protecting the same with a shell protection bar located at one end of the base and extending upwardly along all the lateral surface of the cylinder container A.

Two external stoppers 2 are similar, consisting of a circular base, with an inner threaded external edge 24 approximately 12 mm high and an inner smooth edge 14 that, according to a sectional view, is triangular and approximately 8 mm high. The shape of inner edge 14 facilitates the entrance of the threaded portion of the cylinder container A in the space defined between said external edge 24 and said inner edge 14; in the screwing step, in fact, the threaded portion of the cylinder container A at the start contacts the upper and more flexible portion of inner edge 14 and proceeding in the screwing contacts the harder lower portion. The two edges, i.e. external and inner 24 and 14, respectively, are apart from each other like the thickness of threaded sides of the cylinder container A so that, in closing step, i.e. during the screwing of the stoppers 2 around the ends of the cylinder container A, the two edges, external and inner 24 and 14, respectively, block the cylinder container A and support the same defining the structure of the container-unroller object of the invention and leaving opened only the slit 12 as necessary for the sliding of film 1 or similar.

In the centre of stoppers 2, there is a circular hinge 18 with diameter of approximately 14 mm, height of approximately 4.5 cm; the base thereof having a knurled surface 23 joint inserted in a correspondent knurled area of the hole of a spring washer 3 acting to prevent the rotation of roll 5 in a direction different than desired.

The washer 3 has, in fact, in the centre a circular knurled hole, with a diameter of approximately 15 mm. The washer 3 has a fixed edge for the three quarters of circumference thereof, approximately 4 mm high; the last length thereof being arched inwardly to generate a spring tooth 22, free and detached from the washer 3 circumference, characteristic allowing a light spring movement, thus forcing an holed toothed stopper 4, once inserted into the washer 3, to rotate only in one-way and blocking it for the other one.

The external stopper 2 and washer 3 can be produced as a single part.

The holed universal toothed stopper 4, occurring only on one of two roll 5 sides, is shaped as a toothed washer with a central hole having a diameter of 15 mm, and an extension consisting of a set of alternated vertical indentations along all the circumference, resulting in raised arched fins 40, that when the roll 5 of film or similar is inserted into the hole 5 are flexed resulting in an inside accommodation and blocking.

The toothed portion of stopper 4 has a circumference little smaller than the inner edge of washer 3, in order to rotate inside and interact with the spring tooth 22, forcing said toothed stopper and consequently film roll 5 to rotate on hinge 18 of the fixed stopper only in exit direction, therefore creating an unidirectional movement.

The universal holed simple stopper 6, occurring on the opposite side of roll 5 with respect to toothed stopper 4, is shaped as a simple washer with an extension consisting of a set of vertical alternated indentations along all the circumference, resulting in raised arched fins 40, that when the roll 5 of film or similar is inserted into the roll 41 are flexed resulting in an inside accommodation and blocking. In the centre there is hole with a diameter of approximately 15 mm, allowing the roll 5 of film to be rotated in hinge 18 of the unscrewable stopper.

Two just described stoppers 4 and 6 act self-blocking inside of the holes of film or similar roll 5 and to rotate the latter within hinges 18 of the closure stoppers 2.

A film or similar roll 5 particularly suitable to be used with the container-unroller of the present invention has a standard size of approximately 30 cm and is made of cardboard, similar to those already commercially available, with the difference of having a smaller circumference in order the volume of rolled up film or similar to be increased and holed stoppers at the ends as above described, namely. a simple 6 and a toothed 4 stopper. Preferably, the rolls 5 of transparent plastic film have on the head edge of the film a strip 20 of rigid paper having a width of approximately 4 cm thus making practical the loading of the film into the slit 12 of the cylinder container A. When the closure stopper 2 is opened, the slit 12 is released, the roll 5 in inserted within the cylinder container 2 by sliding the same longitudinally and at the same time the edge of head of the film, whereon the strip 20 of rigid paper is fixed, is passed through the slit 12, avoiding complications as for example the film curling.

Therefore, once the cylinder container A is closed by screwing again the closure stopper 2, film 1 will be in position suitable to the successive extractions, i.e. it will remain outside of the slit 12, until the film 1 is finished.

Obviously, the container-unroller object of the invention is suitable also for use with any roll type of film or sheet 1 as those already on the market, the arched fins of the holed universal toothed stoppers, namely 4 toothed and 6 simple stopper, allowing the stoppers to be accommodated at the different hole diameters of film or similar rolls already on the market.

The device comprises moreover a pyramidal spirally shaped spring, having a narrower side inserted and blocked in the grooves of the hinge of the closure stopper 2 and it acts keeping under a light pressure all the above listed inner components, particularly toothed stopper 4 inside of the edge of spring washer 3. Moreover, the role of this spring 7 is crucial in order the commercially available rolls to be accommodated being of different lengths.

Obviously, the container-unroller according to just described embodiment of the present invention, with respective cut devices B and C, can have different sizes than above described in order to be accommodated according to the different roll sizes allocable therein.

With reference to FIGS. 8 and 9, some details of a container-unroller according to a second embodiment of the present invention are shown.

In particular, the FIG. 8 shows a cylinder container A' that, close to the slit 12' has an opened semi-cylindrical element 51, whose structure is jointed to that of the cylinder container A', and inside therein is located a device D provided both with means for electric cut and means for tear cut. In particular, the device D has a cylindrical shape and has along a directrix thereof a groove 52, running along all the length of the device D and, together with a further groove 52, along a diametrically opposite directrix, provides an insertion seat for two corresponding portions with toothed profile 53 placed at the two ends of said opened semi-cylindrical element 51. On the two portions of the device D defined by the two grooves 52, there are on one side an extended steel wire 26' and on the other one a saw-toothed bar 28'. By means of snap insertion within the seat defined by the opened semi-cylindrical element 51, the device D can therefore alternatively display outwardly the extended steel wire 26' or the saw-toothed bar 28'.

The internal surface of the opened semi-cylindrical element 51 displays a longitudinal groove 54, inside of which is placed the saw-toothed bar 28' when the same is in resting position (that is it is not towards the outside).

According to this embodiment, it is considered the use, on a side of the cylinder container A', of a second closure stopper 8, shaped in such a way to act as accommodation for electric power supply of the system for hot electric cut, being provided with an axially positioned, hollow cylindrical hinge 55 having the same length as said cylinder container A', wherein batteries 9, an amplifier and a timer are accommodated.

As to the remaining, the container-unroller according to the second preferred embodiment of the present invention has the same elements as the container-unroller according to the previously shown first embodiment.

FIG. 9 finally shows, with reference to the second embodiment of the present invention, a particular trick, applicable also to the first embodiment necessary to assure that the extended steel wire 26' is not loosened due to the expansion as a result of the heating. In particular, one or both the ends of the wire 26' are joined to a respective small piston sliding inside of a seat 57 axially defined inside of the body of the device D, through the coupling with an hinge 58 of said small piston 56, passing through an opening 59, occurring on the surface of the device D. On the small piston 56 a spring 60 acts, pushing the small piston 56 towards the end of the device D, stretching the wire 26'.

The present invention has been described by an illustrative, but not limitative way, according to preferred embodiments thereof, but it is to be understood that variations and/or modifications can be made by those skilled in the art without departing from the scope thereof as defined according to enclosed claims.

The invention claimed is:

1. A container-unroller of a roll (5) of a film, an aluminium sheet or a sheet of similar material, said container-unroller comprising a hollow tubular body (A), that accommodates only one roll (5) of a film, said hollow tubular body (A) being provided with one slit (12,12'), having edges, for the passage of the film or sheet from inside to outside said hollow tubular body (A), said container-unroller additionally being provided with controlling means for one-way rotation of said roll (5), means for hot electric cutting and means for tear cutting, wherein said means for hot electric cutting and said means for tear cutting are placed approximately 3 cm from said edges of said slit (12) in an outside direction wherein said means for hot electric cutting comprise a means for electric current generation and said means for tear cutting consist of a saw-toothed bar wherein said means for hot electric cutting and said means for tear cutting are mounted on a supporting device (D), wherein said container-unroller is sized to be held in one hand, wherein said means for hot electric cutting and said means for tear cutting are placed in different positions on said supporting device (D) and said supporting device (D) therefore alternatively display outwardly said means for electric cutting and said means for tear cutting.

2. The container-unroller according to claim 1 wherein said means for hot electric cutting consists of an extended metallic wire (26'), connected to means for tensioning said extended metallic wire (26') and to said means for electric current generation.

3. The container-unroller according to claim 1, wherein said means for controlling of one-way rotation of said film, aluminium sheet or similar roll comprises all the inside components of said hollow tubular body (A), namely two closure stoppers (2,8), provided with hinges (18,55) having a knurled surface portion (23) at the base, universal holed stoppers applicable to said roll (5), respectively a toothed (4) and a simple (6) stopper for each side of said roll (5), a tooth spring washer (22) on a side of said roll provided with a hole with a groove (21) correspondent to that of said hinges (18, 55) of said two closure stoppers (2, 8), the whole being under a spring pressure.

4. The container-unroller according to claim 3, wherein said two closure stoppers (2, 8) have two edges, one inside of the other, apart from each other as a thickness of a thread of said hollow tubular body (A), the external edge (24) of said stoppers being inwardly threaded.

5. The container-unroller according to claim 3 wherein said holed universal stoppers (4, 6) have a cylindrical body, equipped with a plurality of longitudinal cuts alternated along all the circumference, forming raised arched fins (40).

6. The container-unroller according to claim 3, wherein the core of said roll (5) has reduced circumference, inside of whose self-blocking universal holed stoppers (4, 8) are placed, suitable to rotate said roll (5) within the hinges (18) of said closure stoppers (2, 8).

7. The container-unroller according to claim 1, wherein a transparent plastic film on said roll (5) is coupled to a stiffening strip (20) on a head margin.

8. A container-unroller of a roll (5) of a film, an aluminium sheet or a sheet of similar material, said container-unroller comprising a hollow tubular body (A), said hollow tubular body (A) being adapted to accommodates only one roll (5), said hollow tubular body (A) being provided with one slit (12,12'), having edges, for the passage of the film or sheet from inside to outside said hollow tubular body (A), said container-unroller additionally being provided with controlling means for one-way rotation of said roll (5), means for hot electric cutting and means for tear cutting, wherein said means for hot electric cutting and said means for tear cutting are placed approximately 3 cm from said edges of said slit (12) in an outside direction wherein said means for hot electric cutting and said means for tear cutting are mounted each on one of two-interchangeable supporting devices (B,C), adapted to be coupled with said hollow tubular body, wherein said means for hot electric cutting comprise a means for electric current generation and said means for tear cutting consist of a saw-toothed bar, wherein said container-unroller is sized to allow said container-unroller to be held in one hand, and wherein said means for hot electric cutting and said means for tear cutting are placed in different positions on said respective supporting device (B, C) and said respective supporting device (B, C) therefore alternatively display outwardly said means for electric cutting and said means for tear cutting.

9. The container-unroller according to claim 8, wherein said container-unroller comprises a track (16), placed on the external surface of said hollow tubular body (A), for the alternative insertion of one of said two interchangeable supporting devices (B,C).

10. The container-unroller according to claim 8, wherein said means for hot electric cutting is supporting device (B) for hot electric cutting which has a tubular shape and is provided with an extended steel wire (26), located on a rib of said supporting device (B) for hot electric cutting, an electric circuit fed by rechargeable batteries located inside of said supporting device (B) for hot electric cutting, and operated through a switch (10) placed outside of said supporting device (B) for hot electric cutting, and a profile (15) for matching with said hollow tubular body (A) of the container.

11. The container-unroller according to claim 8, wherein said supporting device (C) for tear cutting has a cylindrical shape and is provided with a saw-toothed bar (28), placed inside of a room (33), and a cylindrically shaped base, at the two ends being equipped with two hinges (31), inserted and freely rotating in corresponding holes (32) of said room (33), allowing the saw-toothed bar to be moved between two positions, namely a cutting and a resting position, driven by means of a tab (34) located nearly at the opposite of said saw-toothed bar, said saw-toothed bar being provided with blocking means, both for cutting and resting steps, consisting of rounded projections (44) on a head of said saw-toothed bar (28) inserted inside of correspondent recesses (46) placed in the walls of said room (33), and a profile (15) for matching with said hollow tubular body (A) of the container.

12. A container-unroller of a roll (5) of a film, an aluminium sheet or a sheet of similar material, said container-unroller comprising a hollow tubular body (A), said hollow tubular body (A) being adapted to accommodate only one roll (5), said hollow tubular body (A) being provided with one slit (12,12'), having edges, for the passage of the film or sheet from inside to outside of said hollow tubular body (A), said container-unroller additionally being provided with controlling means for one-way rotation of said roll (5), means for hot electric cutting and means for tear cutting, wherein said means for hot electric cutting and said means for tear cutting are placed approximately 3 cm from said edges of said slit (12) in an outside direction wherein said means for hot electric cutting comprise a means for electric current generation and said means for tear cutting consist of a saw-toothed bar wherein said means for hot electric cutting and said means for tear cutting are mounted on a supporting device (D) wherein said container-unroller is sized to allow said container-unroller to be held in one hand that may be rotated so that said means for hot electric cutting and means for tear cutting may alternatively contact said film or sheet, and wherein said means for hot electric cutting and said means for tear cutting are placed in different positions on said supporting device (D) and said supporting device (D) therefore alternatively display outwardly said means for electric cutting and said means for tear cutting.

13. A container-unroller of a film, an aluminium sheet or a sheet of similar material wrapped around a roll (5), said container-unroller comprising a hollow tubular body (A), said hollow tubular body (A) being adapted to accommodate only one roll (5), said hollow tubular body (A) being provided with one slit (12,12'), having edges, for the passage of the film or sheet from inside to outside said hollow tubular body (A), said container-unroller additionally being provided with controlling means for one-way rotation of said roll (5), means for hot electric cutting and means for tear cutting, wherein said means for hot electric cutting and said means for tear cutting are placed approximately 3 cm from said edges of said slit (12) in an outside direction wherein said means for hot electric cutting comprise a means for electric current generation and said means for tear cutting consist of a saw-toothed bar wherein said means for hot electric cutting and said means for tear cutting are mounted on a supporting device (D), wherein said container-unroller is sized to be held in one hand and said means for hot electric cutting comprise an extended metallic wire (26') that is connected to means for tensioning said extended metallic wire (26') that comprise a spring (60) that prevents loosening of said extended wire (26') by expansion of said extended wire (26') as a result of heating of said extended wire (26'), and wherein said means for hot electric cutting and said means for tear cutting are placed in different positions on said supporting device (D) and said supporting device (D) therefore alternatively display outwardly said means for electric cutting and said means for tear cutting.

* * * * *